United States Patent [19]

Jones et al.

[11] Patent Number: 4,536,901

[45] Date of Patent: Aug. 27, 1985

[54] INSULATING LINER FOR A WATER CLOSET TANK

[75] Inventors: Robert A. Jones; Jack R. Reichert, both of Kohler, Wis.

[73] Assignee: Kohler Co., Kohler, Wis.

[21] Appl. No.: 723,720

[22] Filed: Apr. 17, 1985

Related U.S. Application Data

[63] Continuation of Ser. No. 534,986, Sep. 23, 1983, abandoned.

[51] Int. Cl.[3] ..... E03D 1/00

[52] U.S. Cl. ..... 4/416; 4/329; 4/DIG. 18

[58] Field of Search ..... 4/416, 329, 330, 331, 4/332, 580, DIG. 18; 220/241, 403, 410, 462, 456, DIG. 14

[56] References Cited

U.S. PATENT DOCUMENTS

| | | | |
|---|---|---|---|
| 1,164,962 | 12/1915 | Sayford | 220/403 |
| 2,380,866 | 7/1945 | Overbeke | 220/85 B |
| 2,397,248 | 8/1946 | De Kiss | 138/30 |
| 2,726,404 | 12/1955 | Hansen | 4/68 |
| 2,942,275 | 11/1957 | Norman et al. | 4/416 |
| 3,031,684 | 5/1960 | Schuh | 4/416 |
| 3,191,189 | 6/1965 | Robare | 4/416 |
| 3,302,820 | 2/1967 | Lander | 220/410 |
| 3,377,631 | 4/1968 | Whitney | 4/112 |
| 3,435,101 | 3/1969 | Boorman | 264/45 |
| 3,467,967 | 9/1969 | Steinmann | 4/68 |
| 3,936,565 | 2/1976 | Good | 428/315 |
| 3,965,493 | 6/1976 | Bemis | 4/18 R |

OTHER PUBLICATIONS

Exhibit 7A–p. 69 from Kohler Co., "K-300 Plumbing Products Catalog", dated Apr. 1981.

Exhibit 7B–page of Photos of a 1982 Rubber Liner Prototype (experimental only).

Exhibit 7C–p. 69 from Kohler Co., "K-300 Plumbing Products Catalog", dated Apr. 1982.

Exhibit 7D–A Kohler Co. distributor flyer entitled, "San Miguel Water-Guard", dated May 1982.

*Primary Examiner*—Stephen Marcus
*Assistant Examiner*—Linda J. Sholl
*Attorney, Agent, or Firm*—Quarles & Brady

[57] ABSTRACT

An insulating liner for a water closet tank that has a restricted top opening is disclosed. In one embodiment, the liner is generally rectangular in horizontal cross section so as to define two opposed sets of liner side walls, and one set of the liner side walls converges inwardly and upwardly from a bottom wall of the liner. The liner is formed of a flexible and resilient material so that the liner can be collapsed for insertion into the tank through the restricted tank top opening, and then can be released to resiliently return to its normal configuration where it bears against the interior of the tank side walls.

3 Claims, 8 Drawing Figures

Fig. 7
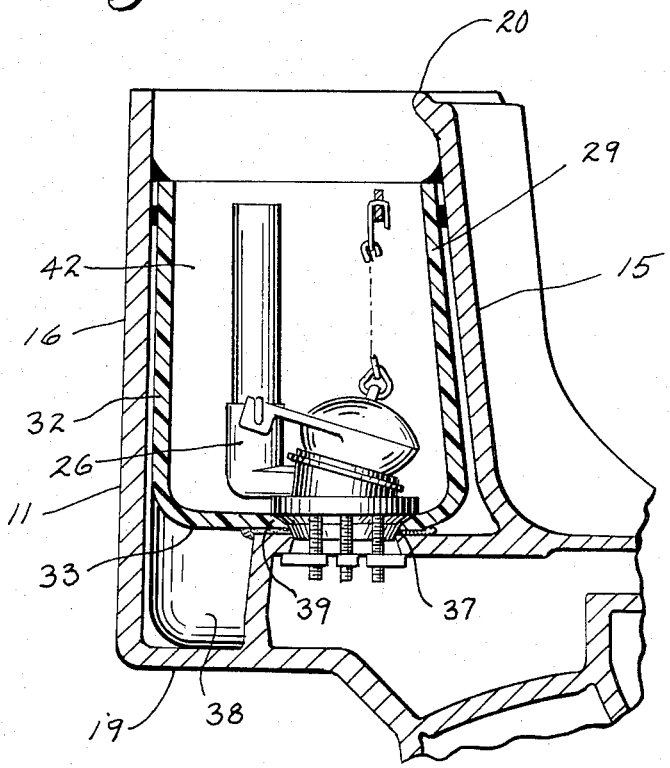
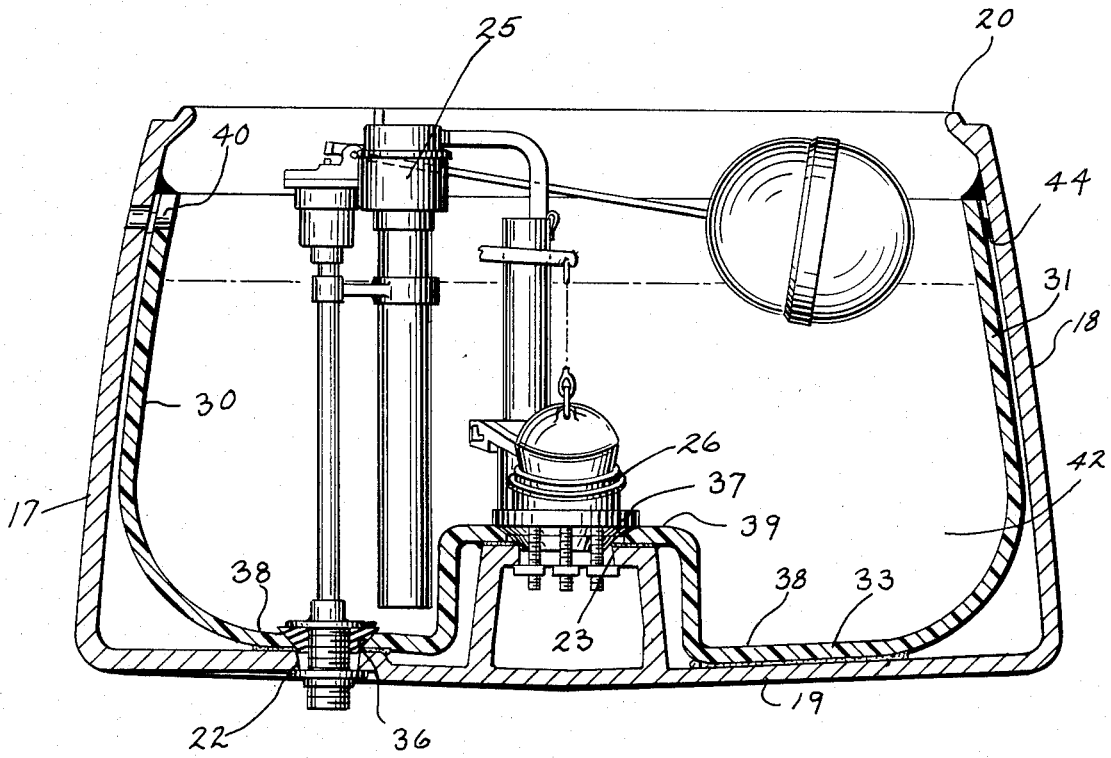
Fig. 8

INSULATING LINER FOR A WATER CLOSET TANK

This application is a continuation of application Ser. No. 534,986, filed Sept. 23, 1983, now abandoned.

BACKGROUND OF THE INVENTION

A. Field of the Invention

This invention relates to water closets in which the water storage tank has a restricted top opening. Specifically, it resides in an insulating liner which is specially designed for use with such tanks.

B. Description of the Art

Sweating of water closet tanks on hot and humid days has long been a source of annoyance, and a cause of damage to bathroom floors. For this reason, drip trays attached to the bottom of the flush tank were developed to catch condensation. However, these trays were found to be objectionable because of the sanitary and odor problems which resulted when the condensation stood in the tray for extended periods of time.

Another attempt to solve the condensation problem involved the application of an absorbent fabric to the exterior surface of the tank. This covering was intended to soak up any condensation which formed on the tank, and then to let moisture evaporate slowly during less humid periods. However, this approach was unsatisfactory because the fabric could easily become saturated, and because damp fabrics can suffer severe odor problems.

The art then turned to the use of insulating liners which fit inside the toilet tank. These liners formed an insulating barrier between the cold storage water and the outside tank wall, and thus the formation of condensation on the exterior of the toilet tank walls was inhibited. One type of prior art liner, a preformed rectangular rigid plastic liner, could be slid into the top opening of a rectangular tank. Another type of liner, another form of rigid plastic liner, could be formed in place by various casting methods.

While such liners were acceptable for conventional rectangular tank designs, highly ornamental water closets were developed that had tanks that were "low profile" and generally trapezoidal in shape. When conventional rectangular preformed liners are placed into these low profile, trapezoidal shaped tanks, there is often too much waste of water storage space along the sides of the tank. This volume loss is critical due to the additional loss from narrowing of the tank near its top. (The less storage water available, the harder it is to completely clean the bowl with one flush.)

If one chooses to make a prior art rigid preformed liner conform to the design of a trapezoidal tank (so as to maximize water storage space), one would not be able to get the rigid liner through the "restricted" top opening. Moreover, if one tries to mold a liner in place which conforms to the inwardly sloping tank walls, conventional molding techniques become very difficult and expensive (e.g. getting a one-piece core out of a negative mold).

Thus, it can be seen that the need has existed for an improved means of preventing water condensation on the exterior of a low profile, trapezoidal shaped toilet tank.

SUMMARY OF THE INVENTION

The invention provides an insulating liner for a water closet tank that has bottom and side tank walls, and a top opening. The tank walls define a tank water storage chamber, at least part of which is larger in horizontal cross sectional area than the top opening of the tank.

In accordance with the present invention, a liner is provided that has bottom and side liner walls that are formed so as to be substantially coextensive with the interior surface of the tank bottom wall and tank side walls. The liner side walls are normally configured so that the horizontal cross sectional area defined by the exterior of the liner side walls at a certain height is greater than the cross sectional area of the tank top opening, and the liner side walls are designed so as to normally lie against the interior of the tank side walls. At least part of the liner is made of a flexible and resilient material so that the liner can be collapsed for insertion in the tank through the tank top opening, and then can be released to resiliently return to its normal configuration.

The preferred liner material is low density foamed polyethylene, a material having great insulating properties, which is suitable for use in a water environment, and which is very flexible and resilient. While the entire liner can be formed in a rotational molding process, other conventional molding techniques may also prove to be appropriate. Also, rather than making the entire liner structure of the flexible and resilient material, just the bottom wall of the liner can be formed of the material, and/or one or more of the side walls of the liner.

In an especially preferred embodiment, the liner is generally rectangular in horizontal cross section to define opposed sets of liner side walls, and at least one set of the opposed liner side walls converges inwardly and upwardly from the bottom wall. Similarly, both sets of opposed liner side walls can converge inwardly and upwardly from the bottom wall.

An especially desirable aspect of the present invention is that the liner can be formed with a bottom wall that has a saddle shape in which there is a raised portion having an outlet hole formed in it, and a lower portion adjacent to the raised portion in which there is an inlet hole formed. This design renders the liner especially suitable for use where building codes require the outlet to be elevated with respect to certain siphoning elements of the bowl to prevent backflow, yet water storage capability must be maximized.

The objects of the invention therefore include:

a. providing an insulating liner of the above kind which inhibits water condensation on the outside of a generally trapezoidal, low profile water tank;

b. providing an insulating liner of the above kind which is collapsible so as to allow easy installation through a restricted tank top opening, yet which is sufficiently resilient so as to return to its normal configuration after insertion in the tank;

c. providing a very thin insulating liner of the above kind which maximizes water storage space;

d. providing an insulating liner of the above kind which is inexpensively constructed and installed, and which is highly durable.

These and still other objects and advantages of the invention will be apparent from the description which follows. In this description, the preferred embodiments of the invention will be described with reference to the accompanying drawings. These embodiments do not represent the full scope of the invention, but rather the invention may be employed in other embodiments. Reference is therefore to be made to the claims herein for interpreting the scope of the invention.

BRIEF DESCRIPTION OF THE DRAWINGS

FIG. 7 is a partial sectional view taken on line 7—7 of FIG. 2, after the liner of the present invention and portions of the flush control mechanism have been installed in the tank; and FIG. 8 is a partial sectional view taken on line 8—8 of FIG. 2 after the liner of the present invention and portions of the flush control mechanism have been installed in the tank.

DESCRIPTION OF THE PREFERRED EMBODIMENTS

Figure 1:
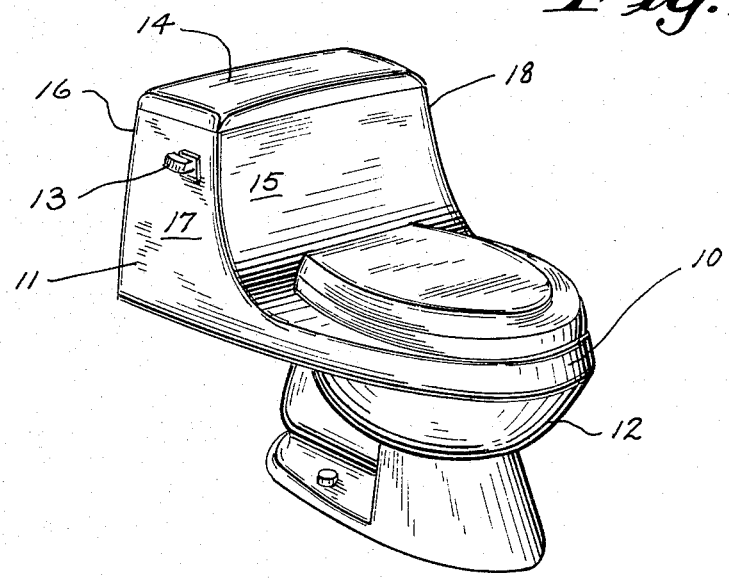
FIG. 1 is a perspective view of a low profile water closet having a generally trapezoidal shaped water storage tank.
Figure 2:
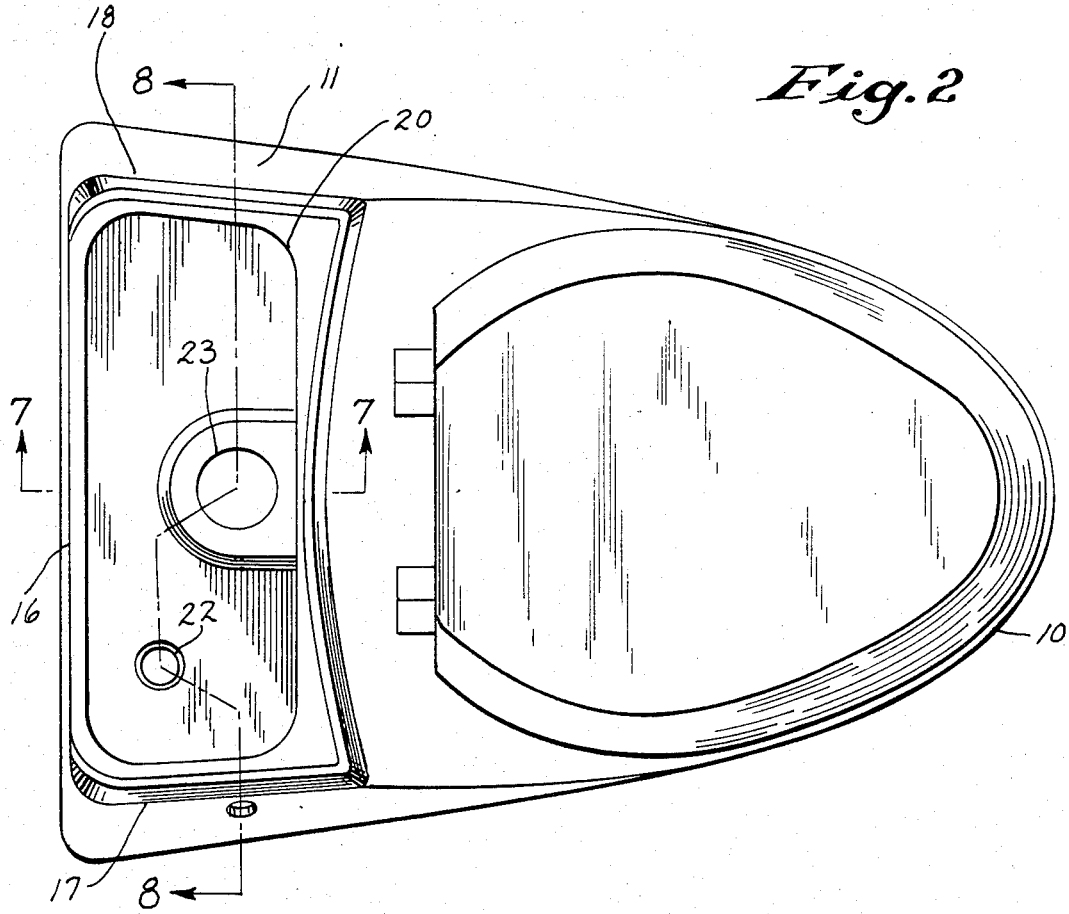
FIG. 2 is a top plan view of the water closet of FIG. 1, with the tank cover removed.

In FIGS. 1 and 2 of the drawings, there is shown a low profile water closet 10 having a generally trapezoidal shaped water storage tank 11. The toilet has the usual bowl 12, trip level 13, and toilet tank lid 14.

The tank 11 has a front side wall 15, a rear side wall 16, a left side wall 17, a right side wall 18, and as best seen in FIG. 7, a bottom tank wall 19. At the top of the tank 11 there is a restricted top opening 20. "Restricted" is used in this context to mean that the area of the opening is less than the horizontal cross sectional area of the tank water chamber at a certain height, the water chamber being defined by the interior surfaces of walls 15–19.

Other features of the tank 11 include an inlet 22 through which water is received, and an outlet 23 through which water exits. In the usual way, a conventional inlet float valve 25 (see FIG. 8) can control the inflow of water in response to the water level of the tank, and conventional outlet flush ball 26 can be activated by the toilet trip lever 13.

Figure 3:
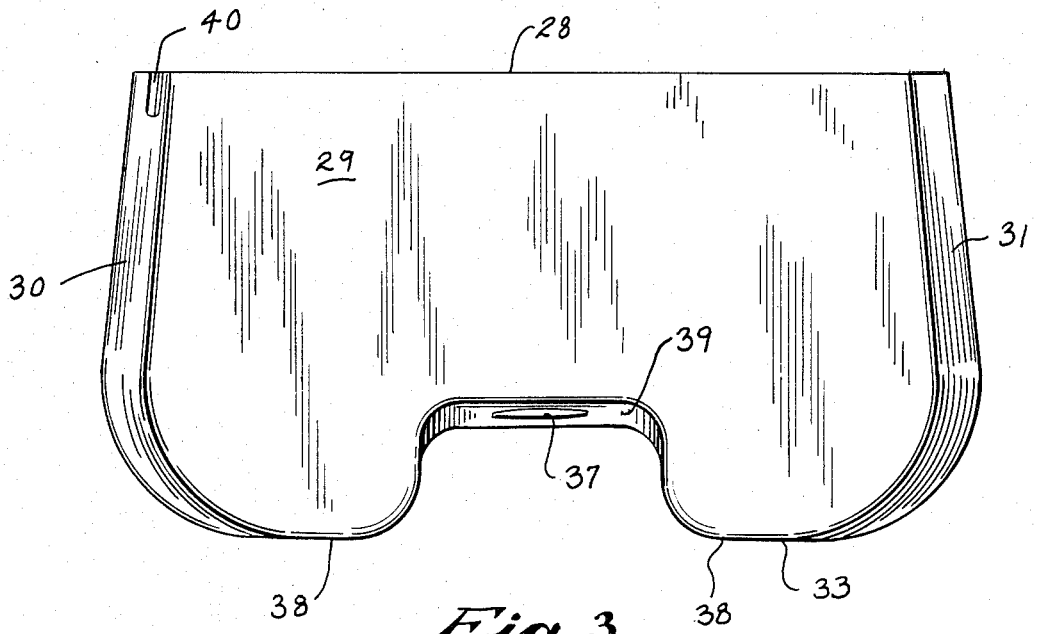
FIG. 3 is a front elevational view of the liner of the present invention.
Figure 4:
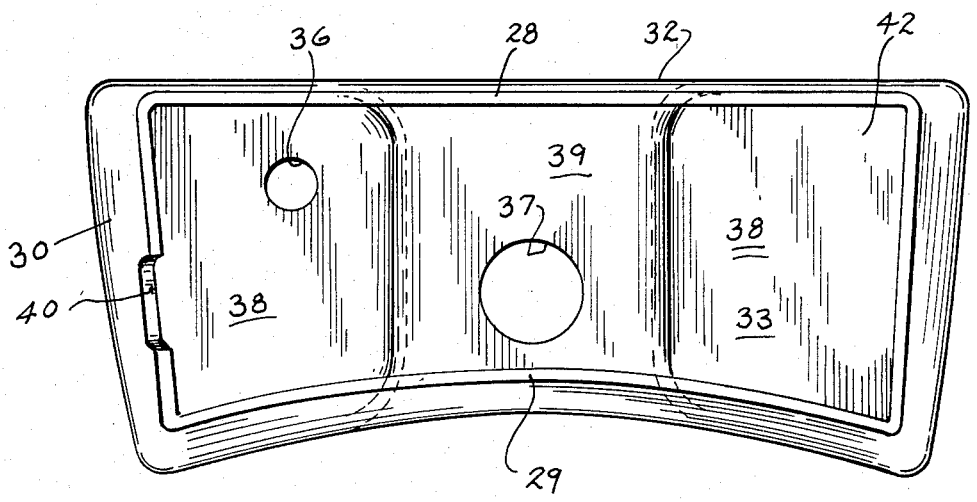
FIG. 4 is a top plan view thereof.
Figure 5:
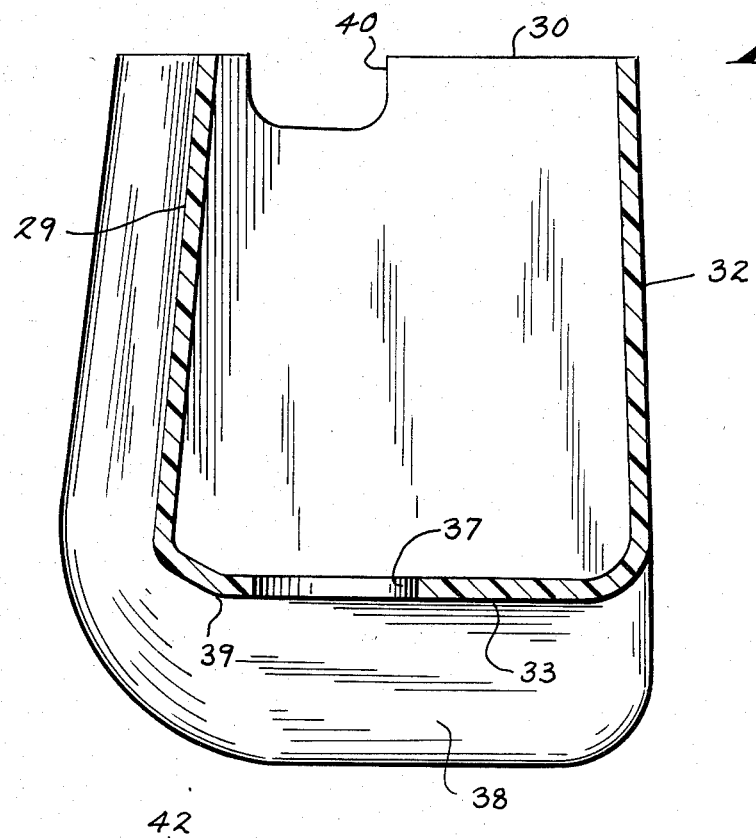
FIG. 5 is a cross sectional view taken across the middle of the liner of FIG. 3.

The liner 28 is depicted in detail in FIGS. 3–5 of the drawings. It has a front side wall 29, right and left side walls 30 and 31, a rear side wall 32, and a bottom wall 33. Opposed side walls 30 and 31 slope upwardly and inwardly towards each other so do opposed side walls 28 and 29. This forms the generally trapezoidal outer shape of the liner 28.

It will also be appreciated that a horizontal cross section through the liner side walls will be generally rectangular. As can be seen from FIG. 4, the term "generally" rectangular is meant to include walls such as wall 29 even though they have an irregularity such as a contour.

The liner 28 also has an inlet hole 36 which corresponds to the tank inlet hole 22, and a bottom wall outlet 37 which corresponds to the tank outlet 23. The bottom liner wall 33 has a raised central portion 39 in which the outlet hole 37 is formed, and two lower portions 38 adjacent to the raised portion 39. The inlet hole 36 is formed in one of the lower portions 38. When viewed as in FIG. 3, the bottom wall of the liner therefore takes on a "saddle" shape.

The position of the trip lever 13 on the outside of the tank 11 can, of course, be varied. For certain placements, a cut such as cut 40 can be made in the liner 28 so as to allow for appropriate clearance of the trip lever mechanism once the trip lever 13 is positioned.

It will be appreciated from FIGS. 7 and 8 that the liner side and bottom walls 29–33 are formed so as to be substantially coextensive with the interior surface of the tank bottom and tank side walls 15–19, and the liner side walls are designed to lie against the tank side walls 15–18. The term "substantially" is used in this context so as to include situations where the liner walls do not conform exactly to the tank walls. Note for example that FIGS. 7 and 8 show that to save material some space can be left below the back portion of bottom wall 39 and/or along the lower side corners of the liner 28. Also, FIG. 7 shows that the liner need not extend all the way to the top of the tank 11. Normally, however, the liner 28 will be molded so as to conform as closely as possible to the tank interior to save water storage space.

Figure 6:
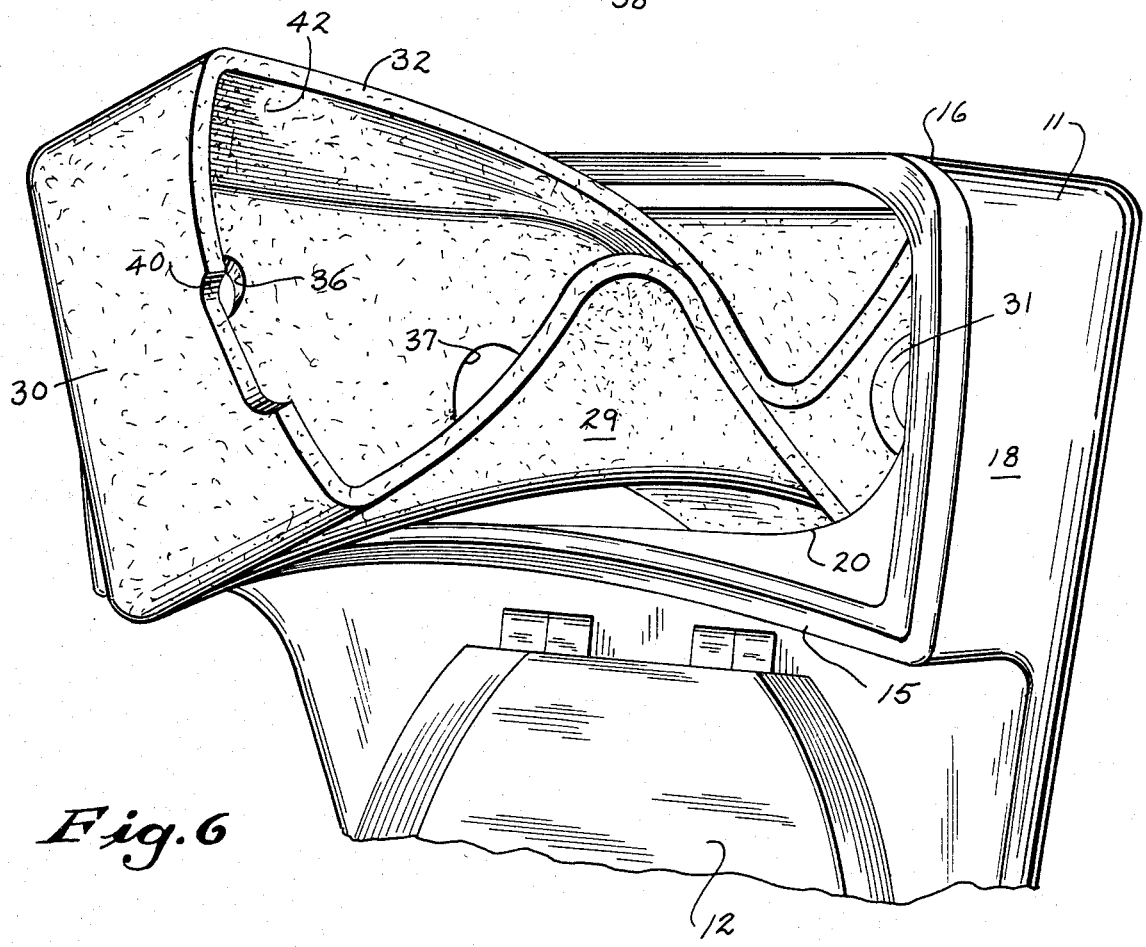
FIG. 6 is a perspective showing the liner of FIG. 3 in a partially collapsed condition during installation of the liner in a toilet tank.

The liner 28 can be formed of foamed polyethylene 42 which has a density of less than 0.35 grams per cubic centimeter. Other materials (e.g. plastics) might also prove suitable although the material should have many desirable characteristics. For example, it should be sufficiently flexible so that the liner can be collapsed for insertion in the tank as shown in FIG. 6, and then be sufficiently resilient to return to its normal configuration without substantial deformation. At the same time, the material should be sufficiently thick to inhibit condensation, yet not so thick as to take up needed water storage space. Excellent insulating properties are therefore required. Also, the material should be extremely durable in various types of water environments. Because a material must have all these characteristics, selection of a material requires great care.

To form the preferred polyethylene liner 28, a number of conventional molding techniques can be used. For example, medium density polyethylene can be placed in a rotational mold. A standard USI foaming agent can then be placed in the mold, and the walls of the mold can then be heated as the mold is slowly rotated. During this process, the heated medium density polyethylene will turn into low density polyethylene foam that adheres to the walls of the core. While the liner 28 is shown as being formed entirely from low density foamed polyethylene, the liner will also be suitable for some applications if just the side and/or bottom wall(s) of the liner are flexible and resilient.

FIG. 6 shows how the liner 28 is installed. It is simply crushed like a piece of paper, inserted through the opening 20, and then released. As an added feature, the liner can be held in place by appropriate adhesives 44.

Thus, the invention provides an improved means of inhibiting water condensation on the exterior of a toilet tank that has a restricted top opening. While the preferred embodiments have been described above, it should be apparent to those skilled in the art that a number of modifications and changes can be made to the preferred embodiments without departing from the spirit and scope of the invention.

For example, while the water closet tank and liner shown in the drawings are both of a generally trapezoidal shape, other water closet tank and liner shapes can incorporate the present invention. For example, instead of a straight sloping trapezoidal shape, the tank and liner side wall could have a series of inwardly directed steps.

We claim:

1. An insulating liner for a water closet tank that has bottom and side tank walls and a top tank opening; said tank walls defining a tank water storage chamber, at least part of which is larger in horizontal cross sectional area than the top opening of the tank; said liner comprising:

bottom and side liner walls that are formed so as to be substantially coextensive with the interior surface of the tank bottom wall and tank side walls;

the liner walls normally being configured so that the horizontal cross sectional area defined by the exterior of the liner side walls at a certain height is greater than the cross sectional area of the tank top opening, and the liner side walls are suitable to lie against the interior of the tank side walls;

said liner being formed out of a flexible and resilient material so that the liner can be collapsed for insertion in the tank through the tank top opening, and then be released to resiliently return it to its normal configuration;

said liner having a horizontal cross section which defines at least one set of opposed liner side walls; and said liner being sufficiently flexible and resilient so that the upper ends of the opposed liner side walls may be folded inwardly towards each other to permit the opposed side walls to touch each other along lateral sides of the folds, and then resiliently return to their normal position without substantial deformation of the liner.

2. The liner of claim 1, wherein the liner is formed of foamed polyethylene which has a density of less than 0.35 grams per cubic centimeter.

3. The liner of claim 2, wherein the bottom wall of the liner has a greater horizontal cross sectional area then the liner top opening.

* * * * *